US005083057A

United States Patent [19]

Kim

[11] Patent Number: 5,083,057

[45] Date of Patent: Jan. 21, 1992

[54] PANEL OF COLOR CATHODE RAY TUBE

[75] Inventor: Min S. Kim, Suwon, Rep. of Korea

[73] Assignee: SamSung Electron Devices Co., Ltd., Kyunggi, Rep. of Korea

[21] Appl. No.: 427,514

[22] Filed: Oct. 27, 1989

[30] Foreign Application Priority Data

Oct. 29, 1988 [KR] Rep. of Korea ..... 88-17637

[51] Int. Cl.[5] ..... H01J 29/07

[52] U.S. Cl. ..... 313/479; 313/406

[58] Field of Search ..... 313/479, 406

[56] References Cited

U.S. PATENT DOCUMENTS 4,232,248 11/1980 McCue ..... 313/479

4,638,213 1/1987 Deal et al. ..... 313/479

4,806,823 2/1989 Compen et al. ..... 313/479

*Primary Examiner*—Sandra L. O'Shea

*Attorney, Agent, or Firm*—Robert E. Bushnell

[57] ABSTRACT

A panel of a color cathode ray tube is disclosed which is characterized in that an extended portion contacting the inner face of the skirt portion and facing the inner bottom face of the panel is provided on each of the stud pins, so that the aluminum coating layer is let to extend to the extended portion. According to the present invention, the conventional graphite spreading process for supplementing the electrical connection state between the aluminum coating layer and the stud pins is omitted.

1 Claim, 2 Drawing Sheets

FIG. 3A
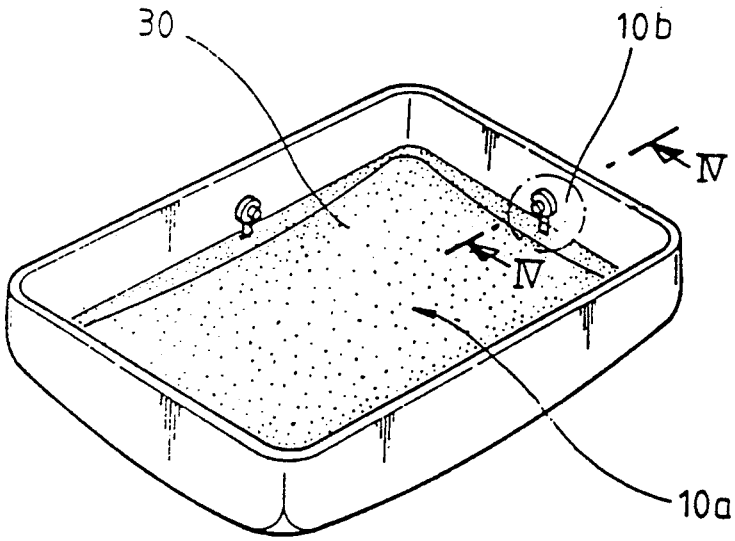
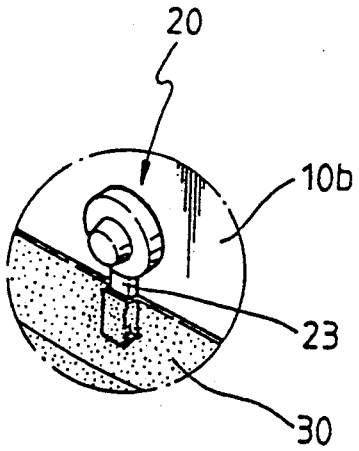
FIG. 3B
FIG. 4
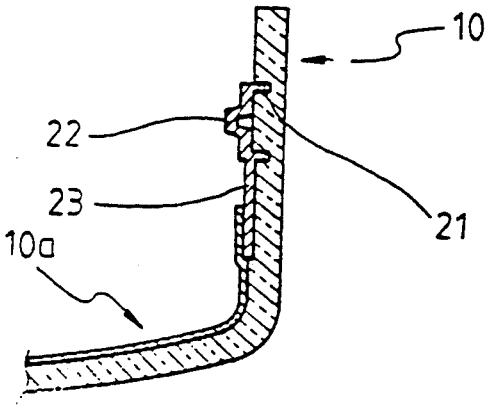
FIG. 5
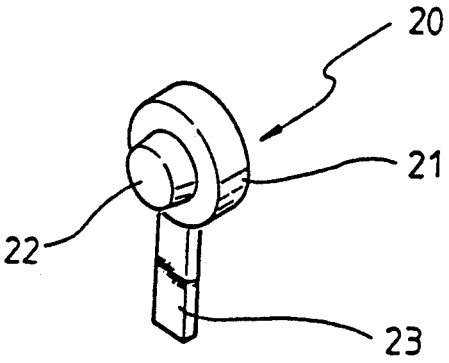

PANEL OF COLOR CATHODE RAY TUBE

FIELD OF THE INVENTION

The present invention relates to a panel of a color cathode ray tube, and particularly to a panel of a color cathode ray tube which is improved in the stud pin for electrically connecting the shadow mask frame assembly and the deposited metal layer of the fluorescent coating.

BACKGROUND OF THE INVENTION

A panel of a color cathode ray tube is provided with not only a screen, but also with a shadow mask for filtering the electron beams advancing toward the screen and a frame for supporting the shadow mask. The frame for supporting the shadow mask is disposed alongside the inner space of the panel by means of a stud pin imbedded on the inner face of the skirt of the panel with some portion thereof protruding, while the stud pin is used for holding a flat plate spring which is weld-fixed at several spots on the side face of the frame.

The above mentioned flat spring serves a role of attaching the shadow mask frame assembly to the panel, and also serves the role of electrically connecting the shadow mask frame assembly to the screen provided on the inner face of the panel. This electrical connection is needed for bypassing the useless electrons remaining on the screen through the shadow mask frame assembly to the ground. The above mentioned useless electrons are indicative of those electrons which can not contribute to realization of the images upon landing upon the screen, and those electrons which remain on the screen after having contributed to realization of the images. Therefore, the structure of the electrical connection between the shadow mask frame assembly and the screen plays an important role.

In the conventional structure of the above mentioned electrical connection, however, there has been a definite factor for product defects which can be attributable to the defective electrical connections, and one of the electrical connections liable to cause the product defects is the connection between the stud pin and the screen.

Generally, as shown in FIGS. 1 and 2, the electrical connection between the stud pin and the screen is constituted such that an aluminum coating layer 3 as one element of the screen is extended to a part of the body of the stud pin 2.

During the process for depositing aluminum coating layer 3, the evaporated aluminum atoms can not reach sufficiently to the portion shielded by the stud pin 2, i.e., the portion A on the drawing, thereby making it impossible to expect a perfect electrical connection between the stud pin and the screen. Such a phenomenon frequently occurs actually through the manufacturing process, and to overcome this problem, graphite which is a conductive material is supplementally spread. The use of graphite, however, can also bring problems, such that the graphite layer itself is formed in an imperfect manner so as for the intended target not to be attained, or that, during the spreading of graphite, the graphite fluid can splash on the screen, i.e., the aluminum coating layer so, as for the screen to be polluted.

SUMMARY OF THE INVENTION

Therefore, it is the object of the present invention to provide a panel of a color cathode ray tube in which the electrical connection between the stud pin and the aluminum coating layer of the screen is improved to a perfect level.

In achieving the above object, the panel of a color cathode ray tube according the present invention comprises: an aluminum coating layer formed on the inner face of the panel; and two or more stud pins secured on the inner face of the skirt portion, wherein an extended portion contacting the inner face of the skirt portion and facing to the screen is provided on the stud pin, and the aluminum coating layer is made to extend to the extended portion.

BRIEF DESCRIPTION OF THE DRAWINGS

The above object and other advantages of the present invention will become more apparent by describing in detail the preferred embodiment of the present invention with reference to the attached drawings in which:

FIGS. 3A and 3B are perspective views of the panel of a preferred embodiment of a color cathode ray tube according to the present invention;

FIG. 4 is a sectional view taken along the line IV—IV of FIG. 3A; and

FIG. 5 is a perspective view of the stud pin adopted for the panel of FIGS. 3A and 3B.

DESCRIPTION OF THE PREFERRED EMBODIMENT

Figure 1:
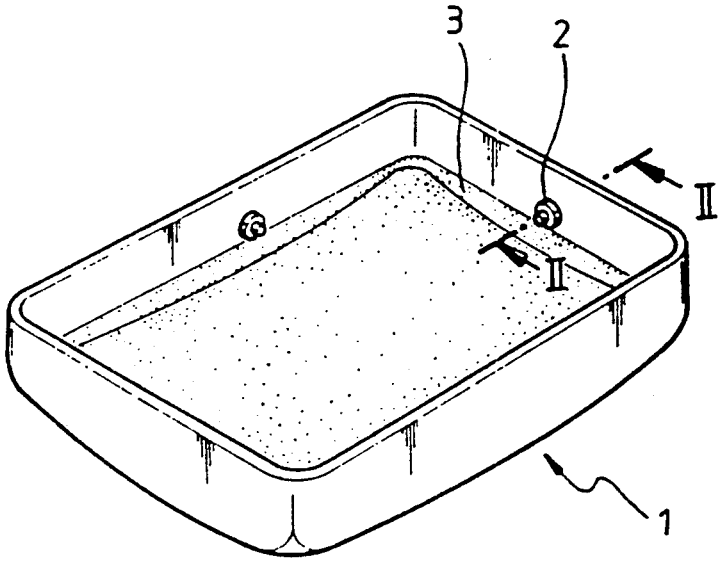
FIG. 1 (Prior Art)
FIG. 1 is a perspective view of the panel of the conventional color cathode ray tube.
Figure 2:
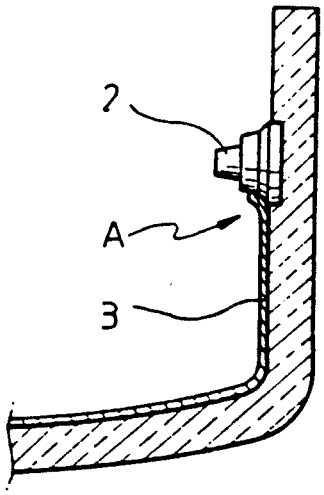
FIG. 2 (Prior Art)
FIG. 2 is a sectional view taken along the line II—II of FIG. 1.

As shown in FIGS. 3A and 3B, an aluminum coating layer 30 forming the surface of the screen is deposited on the inner face 10*a* of a panel 10, while, as shown in FIG. 5, a plurality of stud pins 20 each having respectively a projecting portion 22, a buried portion 21 and an extended portion 23 are secured to the inner face of the skirt portion 10*b*. The projected portion 22 is for installing a spring which is welded to the shadow mask frame assembly (not shown), and the buried portion 21 is for being imbedded into the skirt portion 10*b*. The extended portion 23 is for contacting the aluminum coating layer 30, and as shown in FIG. 4, this extended portion 23 is disposed in such a manner as to face toward the inner face 10*a* of the panel 10, so that the aluminum coating layer 30 can be coated on this extended portion 23.

The coatable length of the extended portion 23 is determined by the total length of the extended portion 23, and is variable depending on the size of the product and other conditions. The above provision brings the result that the aluminum coating layer 30 does not have to directly contact the body of the stud pins 20, unlike the case of the conventional techniques, and further, it is possible even to separate the stud pins from the aluminum coating layer at a proper distance.

In the panel according to the present invention as described in detail above, the electrical connection between the aluminum coating layer and the stud pins is perfectly formed through the aluminum coating process, and therefore, the troublesome tasks as seen in the conventional techniques are removed. That is, the graphite spreading process for supplementing the electrical connection between the aluminum coating layer and the stud pins is omitted, and accordingly, the product defects caused by the spraying of the graphite fluid can be avoided. Further, regardless of the thickness of the coating layer relative to the skirt portion of the panel, a sufficient and stable electrical connection can be achieved through the provision of the extended portion of the stud pin, with the result that the deposition process can be carried out in a more convenient manner.

What is claimed is:

1. A panel of a color cathode ray tube, comprising:

an aluminum coating layer formed on the inner face of said panel; and two or more monolithic stud pins installed on the inside of a skirt portion of the panel, each of said stud pins being provided with a protruding portion engaging an area on the inner face not covered by said aluminum coating layer and with an extended portion unitary with said protruding portion and extending between said protruding portion and a said aluminum coating layer, so that said aluminum coating layer engages said extended portion.

* * * * *

UNITED STATES PATENT AND TRADEMARK OFFICE

CERTIFICATE OF CORRECTION

PATENT NO. : 5,083,057

DATED : 21 January 1992

INVENTOR(S) : Min -Soo KIM

It is certified that error appears in the above-identified patent and that said Letters Patent is hereby corrected as shown below:

Column 1, Line 52, insert --(-- before "i.e.,";

Line 53, insert --)-- after "drawing";

Line 63, insert --(-- before "i.e.,";

Line 64, insert --),-- after "layer", and delete the comma after "so";

Column 2, Line 5, insert --to-- after "according".

Signed and Sealed this

Twenty-fifth Day of May, 1993

*Attest:*

*Attesting Officer*

Michael K. Kirk

MICHAEL K. KIRK

*Acting Commissioner of Patents and Trademarks*